US005100368A

United States Patent [19]

Chien

[11] Patent Number: 5,100,368

[45] Date of Patent: Mar. 31, 1992

[54] SPEED VARIABLE TRANSMISSION SYSTEM

[75] Inventor: Shi-Hai Chien, 4th Fl., No. 18, Alley 60, Lane 22, Sheh Tze Street, Taipei, Taiwan

[73] Assignees: Shi-Hai Chien; Peter B. S. Liao, both of Taipei, Taiwan

[21] Appl. No.: 667,900

[22] Filed: Mar. 12, 1991

[51] Int. Cl.[5] ..... A63H 31/00

[52] U.S. Cl. ..... 475/149; 446/462; 446/463

[58] Field of Search ..... 475/149; 310/83; 180/65.6, 247; 446/462, 463

[56] References Cited

U.S. PATENT DOCUMENTS

| | | | |
|---|---|---|---|
| Re. 13,853 | 12/1914 | Krohn | 310/83 X |
| 1,348,539 | 8/1920 | Breitenbach | 475/149 X |
| 4,130,172 | 12/1978 | Moody | 180/65.6 |
| 4,571,343 | 4/1985 | Goldfarb et al. | 446/463 |

*Primary Examiner*—Dirk Wright
*Attorney, Agent, or Firm*—Browdy and Neimark

[57] ABSTRACT

The present disclosure is related to an improved speed variable transmission system adapted for, in particular, electrically operated vehicle. The system is operated by common manual gear shift. The manual gear shift has a power source made up of a specially designed electric motor having a rotatable outer shell relatively moveable with respect to a core rotor so that the power from the rotatable outer shell and the core rotor of the electric motor can be output respectively to a front and a rear differential gear device, and the vehicle can be powered to move via the differential gear devices. The respective transmission shafts between the electric motor and the front and rear differential gear devices can be selectively locked so that the power from the motor can be selectively varied when output to the differential gear devices thereby the wheels of the automobile can be varied in speed.

3 Claims, 5 Drawing Sheets

SPEED VARIABLE TRANSMISSION SYSTEM

FIELD OF THE INVENTION

The present invention relates to a transmission gear shift system mainly adapted for an electrically operated automobile; in particular, the application is made to a remote control electrical automobile. The manually operated gear shift system can effect 3-stage speed variation.

Remote control electrical automobile has been developed in years to a satisfactory level as a result of the improvement in radio technology. However, the mechanical transmission adopted in the field has still not been changed in cope with the promotion in radio technology too much. The conventional electrical automobile employs a D-C electrical motor and a simple transmission system which is comprised of a simplified differential device. By change of the gear ratio of the transmission device, a proper torsion can be selected to meet the requirement in power.

However, the general type of remote control electrical automobile is not equipped with effective gear shift system so to permit the controlled automobile to run more in response to the driving condition.

The inventor has put a long period of time in studying the transmission system in electrical automobile and finally comes up with a gear shift system operated manually.

SUMMARY OF THE INVENTION

The primary object of the present invention is to provide a manual gear shift system mainly adapted for electrically operated automobile, wherein a specially designed motor, which has a rotatable stator made up of the shell thereof and a rotor, is employed. The rotatable shell-stator is relatively moveable against the rotor and the motor serves as a power source of the automobile. A pair of differential gear devices made up of gears having different gear ratios are employed to control the operation of the wheels. Besides, by way of selectively locking the transmission shafts of the automobile, the speed of the wheels can be accordingly varied.

To better illustrate the structural features and operational modes of the present invention, a number of drawings are given in company with a detailed description of the preferred embodiment, in which;

DETAILED DESCRIPTION OF THE PREFERRED EMBODIMENTS

Figure 1:
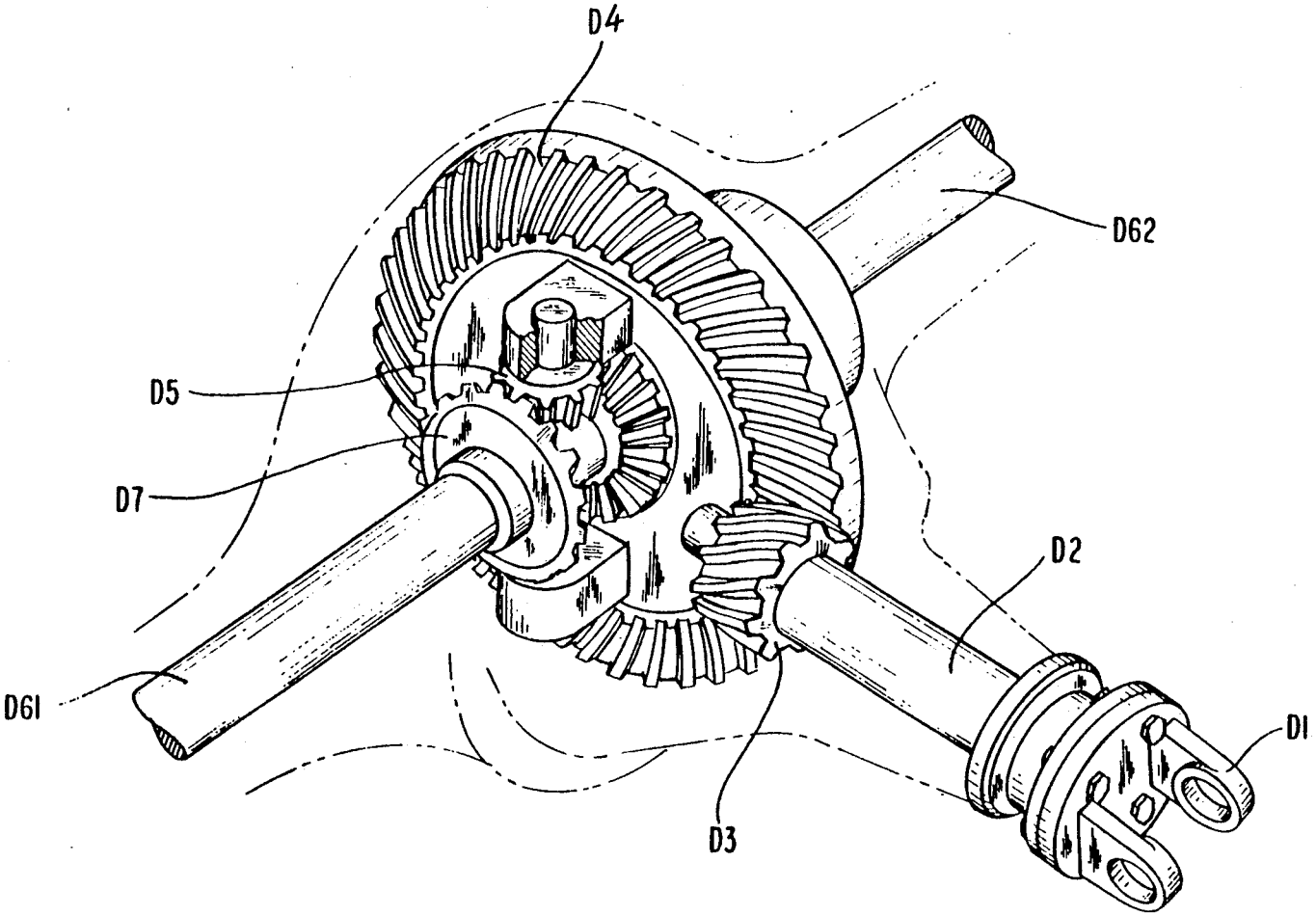
FIG. 1 (PRIOR ART)
FIG. 1 is a perspective view of a conventional transmission device.

Referring to FIG. 1, a conventional differential gear set is related to the engine by way of a universal joint D1 and a rotation shaft D2. The end of the rotation shaft D2 is attached with a helical gear D3 which is engaged with the annular gear D4 of the differential gear set. A pair of planet gears are engaged with the rotating annular gear D4 so that the engine power can be output to a left and right drive shaft D61 and D62 respectively. As it is well known that when one of the drive shaft D61 or D62 is locked not to rotate, the other left drive shaft D62 or D61 will take all the power from the engine. This idea constitutes the central idea of the present invention.

Figure 2:
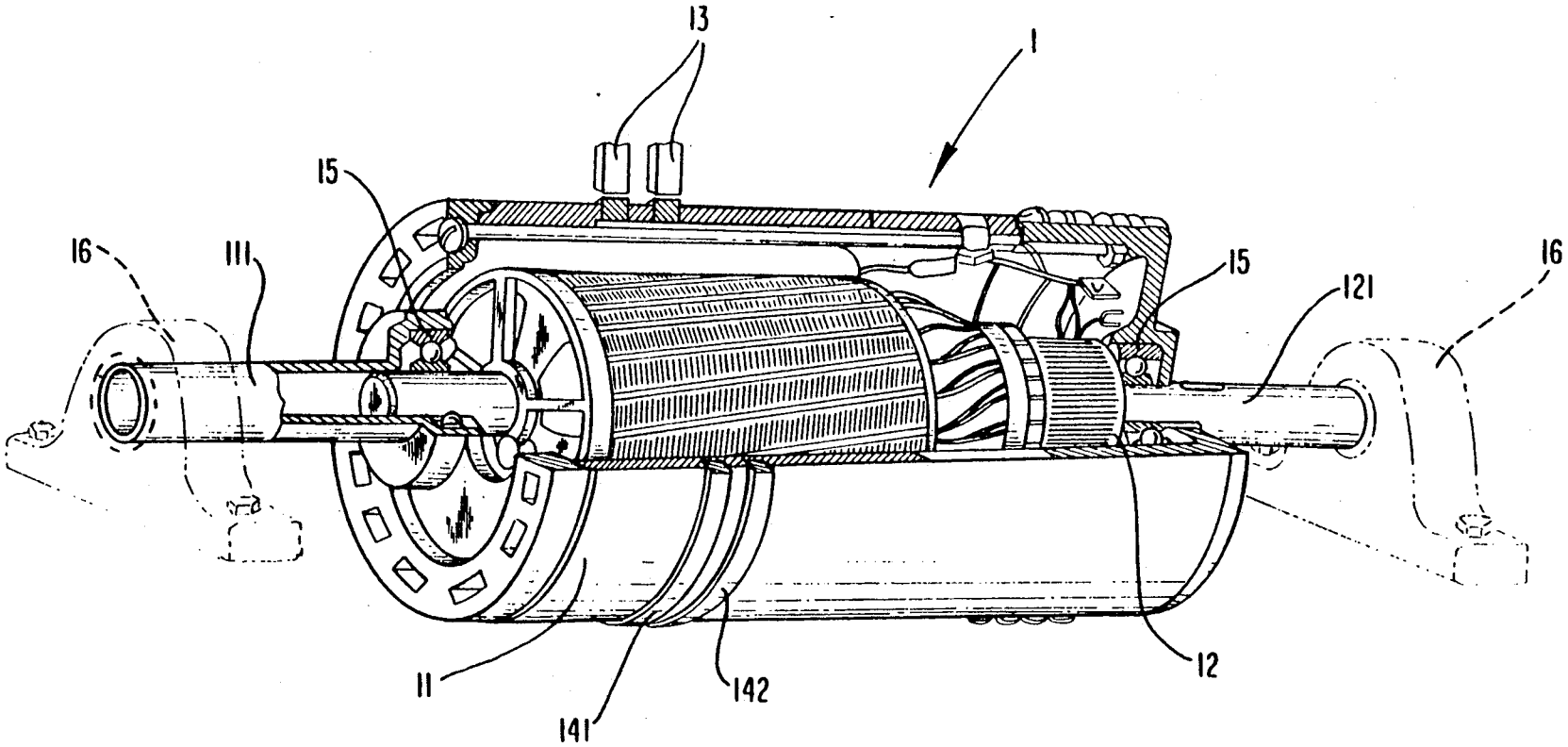
FIG. 2 is a perspective sectional view of the relative-rotation motor for the gear shift system of the present invention.

As shown in FIG. 2, a specially designed electric motor 1 which is so called relative-rotation motor, is employed as the power source of the electrical automobile of the present invention. This special motor is structured to have a rotatable outer shell serving as the stator 11 of the motor and a core rotor 12, that are in opposite rotation when the electrical motor is in operation. Thereby the power produced by the relative-rotation electric motor 1 can be output in both directions.

To permit the outer shell stator 11 to rotate freely, the electrical power source is introduced into the electric motor by way of a pair of copper rings 141, 142 disposed on the outer shell thereof. The electrical power of the battery can be input by a couple of corresponding carbon brushes 13 into the motor 1 so that the outer shell stator 11 can be rotated without interference.

At each end of the outer shell stator 11 is disposed a bearing 15 so to keep the core rotor 12 in support, permitting the same to smoothly rotate. The outward extended shaft 121 of the core rotor 12 is identical to a conventional electric motor 1 and serves as a power output terminal. Another power output shaft 111 is integrally disposed at the other end of the outer shell stator 11, extended therefrom and supported by a bearing 16 so that the power of the motor can be output. As to the internal magnetic poles and wiring of the electric motor, they are identical to a common one. The electric motor can be designed with care to let the rotation inertia of the outer shell stator 11 and the core rotor 12 be identical. Thus, the output terminals of the electrical motor 1, i.e., the outer shell stator 11 and the core rotor 12, can respectively hold half of the output power.

When the output terminal 111 of the stator 11 is locked not to rotate, the whole power of the electric motor 1 is directed to the shaft 121 of the core rotor 12; and vice versa. It can be seen that the specially designed relative rotation electric motor can have the same function as a differential gear device to balance the power transmission.

To clarify the operation modes of the manual gear shift system of the present invention, a 3-stage speed variation process is given as below.

Figure 3:
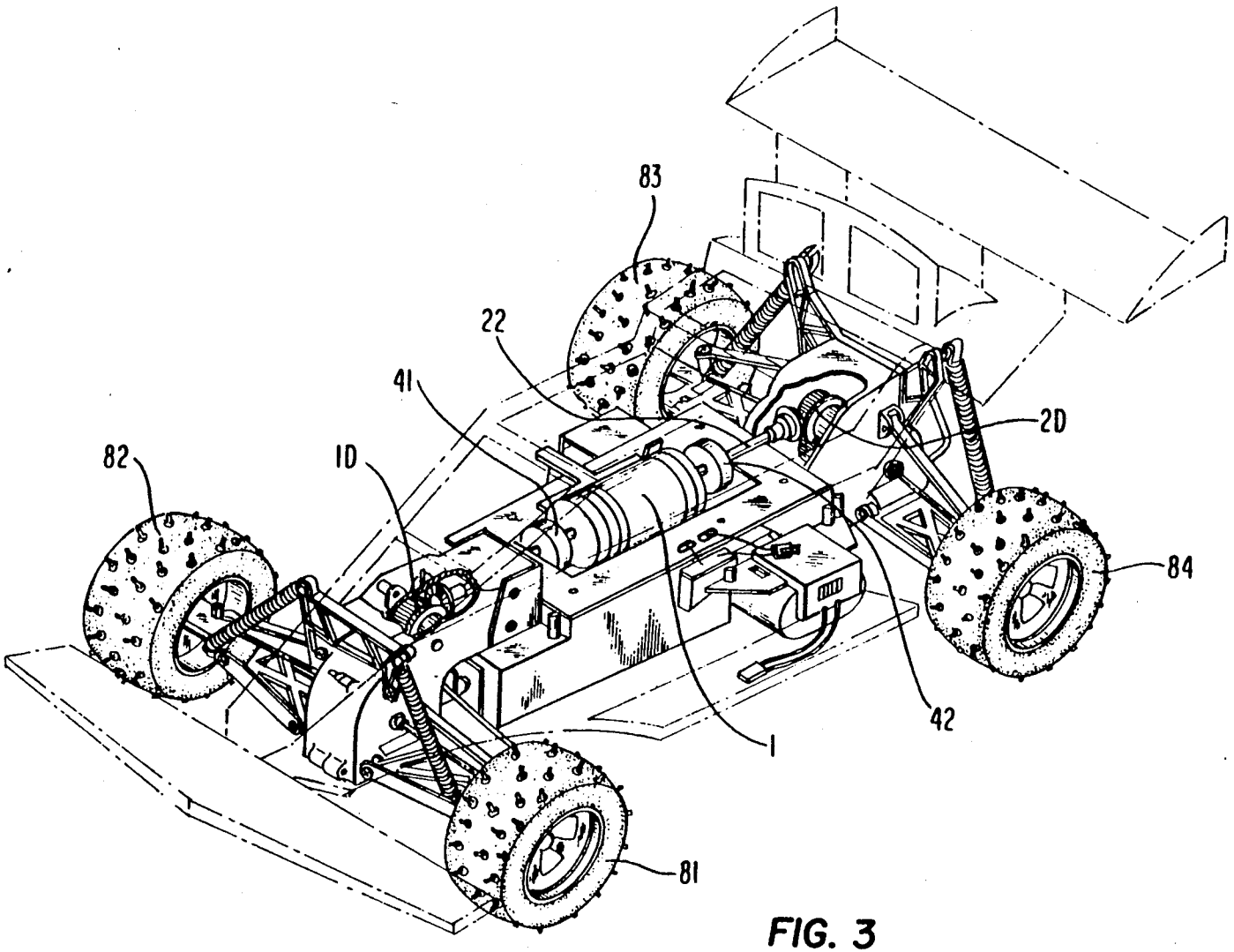
FIG. 3 is a diagram showing the 3-stage gear shift transmission device thereof.
Figure 4:
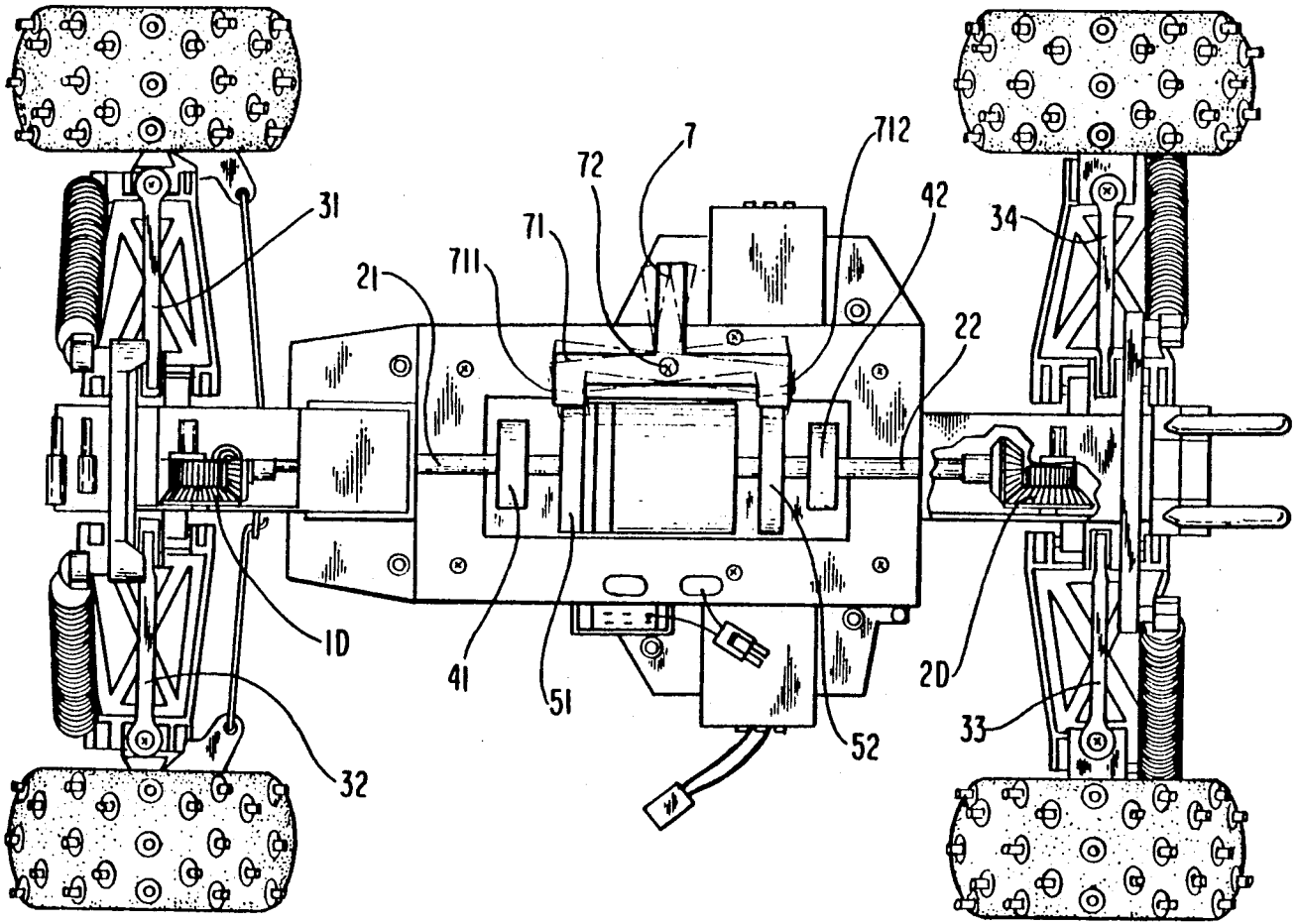
FIG. 4 is a top plane view of FIG. 3.
Figure 5:
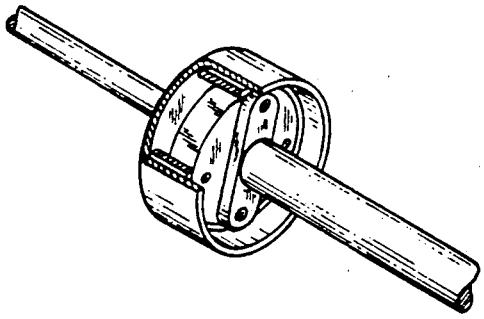
FIG. 5 is a diagram showing the centrifugal clutch of the present invention.

Referring to FIGS. 3, 4, the relative-rotation electric motor 1 serves as the power source, and the same consists of the outer shell stator 11 and the core rotor 12. The power generated by the electric motor 1 is transmitted by way of a front and rear flanged members 51, 52 and the centrifugal clutches 41, 42 as shown in FIG. 3 to the transmission shafts 21, 22 and finally to the front and rear differential gear devices 1D, 2D. Furthermore, four rotation shafts 31, 32, 33 and 34 are employed to convey the power produced by the motor to the respective tires 81, 82, 83, 84.

A control stick 7 with a C-shaped prong 71 at the end thereof is pivotable to a pivot joint 72, as shown by the dotted line in FIG. 4. The prong 71 has a pair of hands 711, 712. When the control stick 7 is put in a neutral position, the two hands 711, 712 are kept away from the surfaces of the flanged members 51, 52 so that the power produced by the electric motor's outer shell stator 11 and the core rotor 12 can be output. Once the control stick 7 is pivoted so such a position with the hand 711 in contact with the round front flanged member 51, the outer shell stator 11 will be locked not to rotate, thus the power produced by the electrical motor 1 goes totally to the core rotor 12. In the same manner, once the control stick 7 is moved to a position with the hand 712 in pressing contact with the round rear flanged member 52, the power produced by the electric motor 1 will be output via the outer shell stator 11. The centrifugal clutches 41, 42 permit the transmission shafts 21, 22 to freely rotate even when the front and rear flanged members 51, 52 are locked so that no braking condition will exist.

It is known from above description that there are 3 different kinds of speed condition produced by the proceeding manual gear shift system.

If the front differential gear device 1D has an annular gear D4, which is engaged with the helical gear D3 disposed at the end of the transmission shaft 21, with the gear ratio therebetween 3:1, referring to FIG. 1; and the gear ratio between the annular gear D4 of the rear differential gear device 2D and the helical gear D3 attached at the end of the transmission shaft 22 is 3:2; and the rotation speed of the relative rotation electric motor 1 has a speed of 9000 rpm, the following conditions can be produced:

1. When the transmission shafts 21, 22 are free to rotate, the core rotor can deliver a 6000 rpm speed to the transmission shaft 21, and the rotation shafts of the front wheels can have a speed of $6000\times\frac{1}{3}=2000$ rpm. Moreover, the outer shell stator can deliver a 3000 rpm speed to the transmission shaft 22, and the rotation shafts of the rear wheels can reach a speed of $3000\times\frac{2}{3}=2000$ rpm. With the four wheels operated at the same speed, the automobile can move on a smooth surface.
2. When the transmission shaft 22 associated with the outer shell stator of the electric motor is locked without rotating, the 9000 rpm speed produced by the electric motor will be output by way of the core rotor to the transmission shaft 21, the rotation shafts of the front wheels will be increased to $9000\times\frac{1}{3}=3000$ rpm (wheel speed), the speed of the automobile is faster.
3. When the transmission shaft 22 associated with the outer shell stator is released to rotate with the transmission shaft 21 coupled to the core rotor locked, the speed of the electric motor 9000 rpm will be delivered to the transmission shaft 22, and the rotation shafts of the rear wheels will reach a speed of $9000\times\frac{2}{3}=6000$ rpm, the vehicle even move more faster.

In case that one of the transmission shafts 21, 22 is locked not to rotate, the front or rear wheels can still be driven to rotate along with the wheels associated with the free transmission shaft due to the use of the centrifugal clutches. The above theory of how the speed of the wheels are varied can be applied in the following manner.

In the first instance given in the previous application, it can be regarded that the automobile is put in the first gear which can provide larger torsional force to make the still wheels to move.

In the second application, the automobile is regarded as in the second gear, only the front wheels are driven; the vehicle is more easily controlled in turning corners and is readily speeded up. The automobile in this condition is suitable for a curved road.

In the third application, the vehicle is identically put in the third gear and only the rear wheels are driven; under this condition, the automobile is best suitable for speeding up in a linear road. When the vehicle is on the move, not much torsion is needed and the third gear is able to obtain a high speed output.

Figure 6:
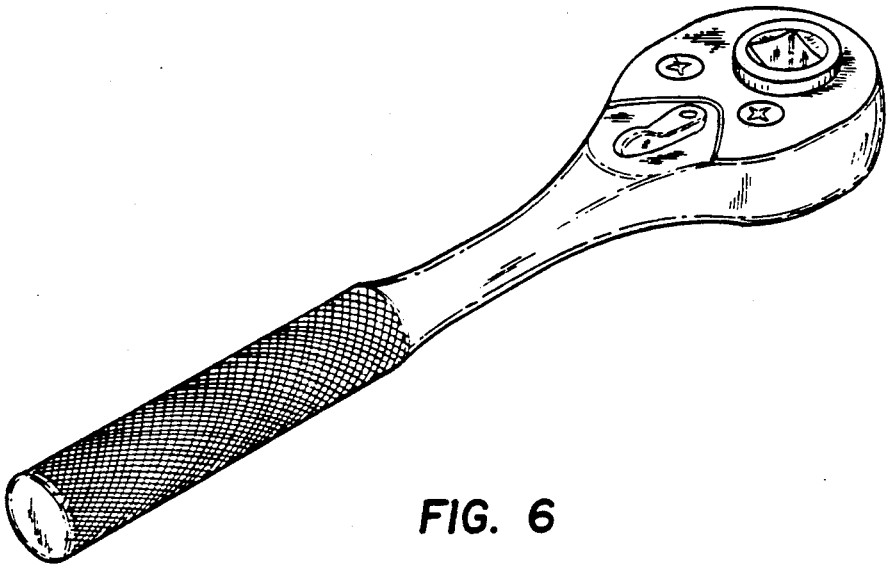
FIG. 6 is a diagram showing a box spanner type ratchet gear means which can be selectively operated.

Moreover, the centrifugal clutch can be replaced by a ratchet gear means which can provide the same function as the centrifugal clutch. However, the ratchet gear will prevent the power generated by the electric motor from transmitting to the wheels when the motor is rotating in reverse direction to reverse the vehicle. In this condition the electric motor is unable to produce any output at all. To overcome the problem, a box spanner type ratchet gear means, which has a neutral position and a clockwise and counter-clockwise positions, is used so to permit the ratchet gear means to be set in 3 options in which the ratchet is limited to spin in only clockwise or counter-clockwise direction or to rotate without restraint at all. The box spanner type gear means can be designed according to the common box spanner as shown in FIG. 6.

I claim:

1. A speed variable transmission system especially adapted for electrically operated vehicle mainly comprising:

a relative-rotation electric motor serving as a power source for the electrically operated vehicle, having a pair of output shafts;

a round front flanged member in association with one of said output shaft of said relative-rotation electric motor;

a round rear flanged member in association with the other said output shaft of said relative-rotation electric motor;

a pair of centrifugal clutches disposed in juxtaposition to said front flanged member and said rear flanged member respectively;

a pair of transmission shafts disposed in association with said centrifugal clutches at one end respectively;

a pair of front and rear differential gear devices connected to the other end of said corresponding transmission shafts respectively;

a control stick having a C-shaped prong with a pair of hands which can be selectively in contact with said round front flanged member or said rear flanged member so as to lock one of said round flanged members not to rotate when said control stick is pivoted to either side from a neutral position of said control stick;

by means of said control stick which can be in selective contact with one of said front and rear flanged members so to lock one of said output shafts not to rotate.

2. A speed variable transmission system for electrically operated vehicle as defined in claim 1 wherein said relative-rotation electric motor mainly comprising:

an outer shell stator which is equipped with an extended output shaft integrally associated with said shell of said motor; said extended output shaft being rotatably supported by a bearing means so that said outer shell stator can be rotated freely;

a core rotor disposed inside said shell stator and rotatably supported by a bearing means located respectively at each end of said shell; said core rotor having an outward extended shaft as a common electrical motor;

said core rotor having the same magnetic poles and wiring of a common electrical motor;

on the outer surface of said outer shell stator being disposed a pair of copper rings which are in constant contact with a pair of carbon brushes so to permit the electrical energy from a battery to deliver to said relative rotation electric motor;

said relative rotation electric motor being characterized in that said outer shell stator is able to rotate in opposite direction with said core rotor so that energy can be output by way of a pair of said output shafts.

3. A speed variable transmission system as defined in claim 1 wherein said centrifugal clutches can be replace by a pair of box spanner type ratchet gear means which can be put in 3 options so that the ratchet gear can be rotated only in clockwise or counter-clockwise direction or without restraint.

* * * * *